United States Patent [19]

Suefuji et al.

[11] 4,382,370

[45] May 10, 1983

[54] REFRIGERATING SYSTEM USING SCROLL TYPE COMPRESSOR

[75] Inventors: Kazutaka Suefuji; Tetsuya Arata, both of Shimizu; Yoshikatsu Tomita, Shizuoka; Sumihisa Kotani, Shimizu; Naoshi Uchikawa, Shimizu; Akira Murayama, Shimizu, all of Japan

[73] Assignee: Hitachi, Ltd., Tokyo, Japan

[21] Appl. No.: 313,496

[22] Filed: Oct. 21, 1981

[30] Foreign Application Priority Data

Oct. 31, 1980 [JP] Japan ..... 55-152073

[51] Int. Cl.[3] ..... F25B 13/00

[52] U.S. Cl. ..... 62/324.1; 62/498; 62/508

[58] Field of Search ..... 62/324.1, 498, 508; 418/55

[56] References Cited

U.S. PATENT DOCUMENTS 3,884,599 5/1975 Young et al. ..... 418/55

4,045,974 9/1977 McCarty ..... 62/324.1 X

*Primary Examiner*—Lloyd L. King

*Attorney, Agent, or Firm*—Antonelli, Terry & Wands

[57] ABSTRACT

A refrigerating system including a refrigeration circuit and a scroll type compressor provided with two volume control mechanisms to allow the system to selectively perform full load operation and unloaded operation. The scroll type compressor includes two scroll members of known construction meshing with each other to define compression chambers and a suction chamber and is combined with the refrigeration circuit having an outdoor heat exchanger, an expansion valve, an indoor heat exchanger and a four-way change-over valve to provide a heat pump type refrigerating system. The volume control mechanisms each include a pair of bypass apertures in the fixed scroll member communicating with a valve chamber having a valve member slidably mounted therein and normally biased to an open position by a spring. The bypass apertures, of which one communicates with the suction chamber and the other communicates with one of the compression chambers, and the valve chamber constitute a bypass passageway. A pressure introducing pipe opens in the valve chamber. Upward movement of the valve member brings the two bypass apertures in communication with each other through the valve chamber to enable the system to perform a volume control operation. In another application, four volume control mechanisms are located symmetrically and divided into two blocks through a flow passage switching device to assign two mechanisms to one block. By this arrangement, the system is able to perform volume control operation in three stages, or able to operate selectively at maximum load, intermediate load and minimum load.

13 Claims, 10 Drawing Figures

REFRIGERATING SYSTEM USING SCROLL TYPE COMPRESSOR

BACKGROUND OF THE INVENTION

1. Field of the Invention

This invention relates to a refrigerating apparatus provided with a scroll type compressor having a volume control mechanism.

2. Description of the Prior Art

A scroll fluid apparatus comprises an orbiting scroll member including an end plate and a wrap of an involute curve or a curve similar to the involute curve located in an upstanding position on the surface of the end plate, and a stationary scroll member including an end plate, a wrap of the same construction as that of the orbiting scroll member, a discharge port formed in the center of the end plate and a suction port formed in an outer peripheral portion, the orbiting and stationary scroll members being arranged in combination such that the surfaces of the respective end plates face each other with the wraps being in meshing engagement with each other. The apparatus further comprises a housing having a suction pipe and a discharge pipe connected thereto which usually contains the two scroll members.

An Oldham's ring is mounted between the orbiting scroll member and a frame or between the orbiting scroll member and the stationary scroll member for preventing the orbiting scroll member from rotating on its own axis, and the orbiting scroll member has a crank shaft in engagement therewith for moving the orbiting scroll member in orbiting movement while avoiding its rotation on its own axis, so as to compress gas in sealed spaces defined between the two scroll members and discharge the compressed gas via the discharge port. This type of scroll fluid apparatus serving as a scroll type compressor is disclosed in U.S. Pat. No. 3,884,599, for example.

The flow rate of the gas may vary depending on the specific volume of the gas drawn by suction into a suction space and the maximum sealed volume of the gas that is transferred from the suction space to the discharge space. The maximum sealed volume being constant, the flow rate would remain constant if the specific volume of the gas were constant.

Some problems are encountered when the scroll type compressor of the aforesaid construction is used as a compressor of a heat pump type refrigerating system. That is, since the volume of the compressor is constant as described hereinabove, changes in load that occur when the system is switched between a cooling mode and a heating mode should be coped with by effecting on-off control of the compressor.

Also, the cooling/heating ratio of a refrigerating system is lower than the ratio of the cooling load to the heating load. Thus when a heat pump type refrigerating system is designed to comform to the cooling load, the volume would not be enough for performing a heating operation, so that an auxiliary heating source would be required for operating the system to effect space heating.

To meet the aforesaid requirements, a scroll type compressor provided with a volume control mechanism has been developed and laid open to public inspection as Japanese Patent Laid-Open No. 28002/79, prior to the filing of this application. The specification of Japanese Patent Laid-Open No. 28002/79 discloses means for varying the suction air volume and the specific volume of the compressor by forming a groove on the surface of the end plate of the stationary scroll member for receiving therein a plunger which is moved in and out of the groove, to thereby provide a bypass passageway that can be opened and closed. However, there is no mention in the Japanese Patent Laid-Open No. 28002/79 of a system for effecting volume control of this scroll type compressor.

SUMMARY OF THE INVENTION

An object of this invention is to provide a refrigerating system using a scroll type compressor wherein volume control of the scroll type compressor can be effected during operation in accordance with the load applied thereto when the system operates in a heating mode or a cooling mode as an air conditioning system so as to improve the energy efficiency of the air conditioning system.

Another object is to provide a refrigerating system using a scroll type compressor capable, when the refrigerating system functions as a heat pump type system for effecting space cooling and space heating, of varying the specific volume of the refrigerating system as the system is switched between a cooling mode and a heating mode, or more specifically capable of enabling the refrigerating system to automatically perform a full load operation in the heating mode and a volume control or unloaded operation in the cooling mode, thereby eliminating the need to use an auxiliary heating system, etc., in the heating mode.

A still another object is to provide a refrigerating system using a scroll type compressor wherein volume control operation is performed following startup of the scroll type compressor until the discharge pressure rises, to thereby reduce the electric input requirements at the time of startup.

The outstanding characteristic of the invention is that to accomplish the aforesaid objects, the scroll type compressor is provided with at least one volume control mechanism including bypass passageways communicating pressure chambers with a suction chamber, and a valve mounted in each of the bypass passageways to open and close the respective bypass passageway by actuating the valve. The compressor provided with this volume control mechanism is combined with an outdoor heat exchanger, an expansion valve, an indoor heat exchanger and a four-way changeover valve to provide a heat pump type refrigerating system, wherein high pressure fluid and low pressure fluid flowing in and through the refrigeration circuit are led to flow passageway switching means via branch lines, to selectively introduce pressurized fluid to the back of the valves of the volume control mechanism by actuating the flow passageway switching means, whereby volume control can be effected by actuating the valve.

An additional characteristic is that four volume control mechanisms are mounted in positions symmetrically disposed and grouped, through the agency of the flow switching means, into two blocks each group comprising two volume control mechanisms, so as to enable volume control operations to be performed in three stages.

BRIEF DESCRIPTION OF THE DRAWINGS

The invention will be described in detail by referring to the preferred embodiments shown in the accompanying drawings, in which.

DESCRIPTION OF THE PREFERRED EMBODIMENTS

Figure 1:
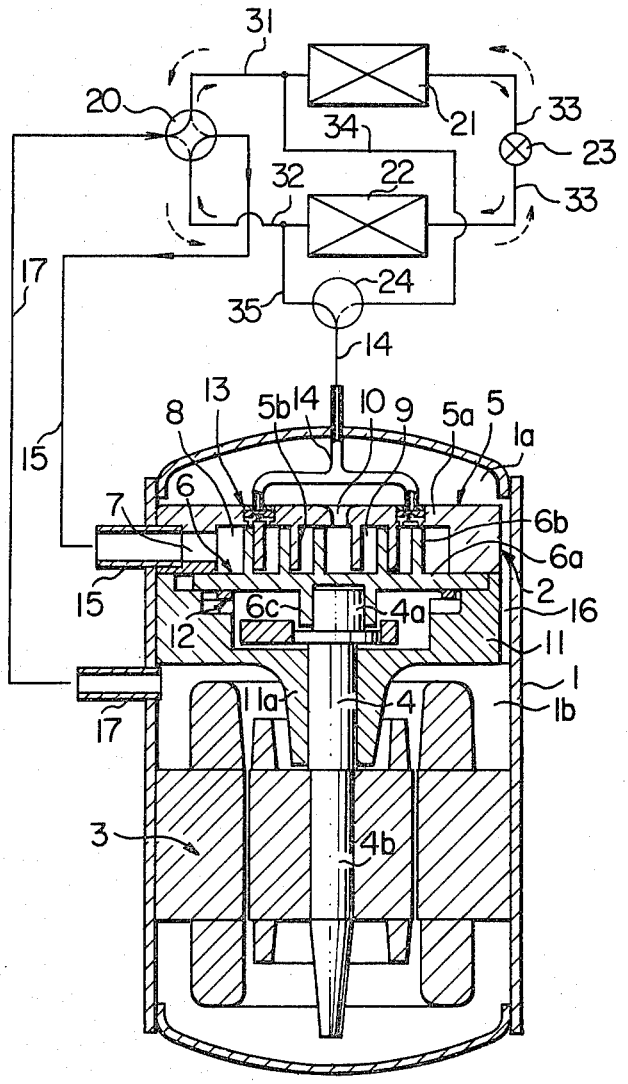
FIG. 1 shows the heat pump type refrigerating system according to one embodiment including a scroll type compressor shown in a vertical sectional view and a refrigeration circuit connected to the scroll type compressor.
Figure 2:
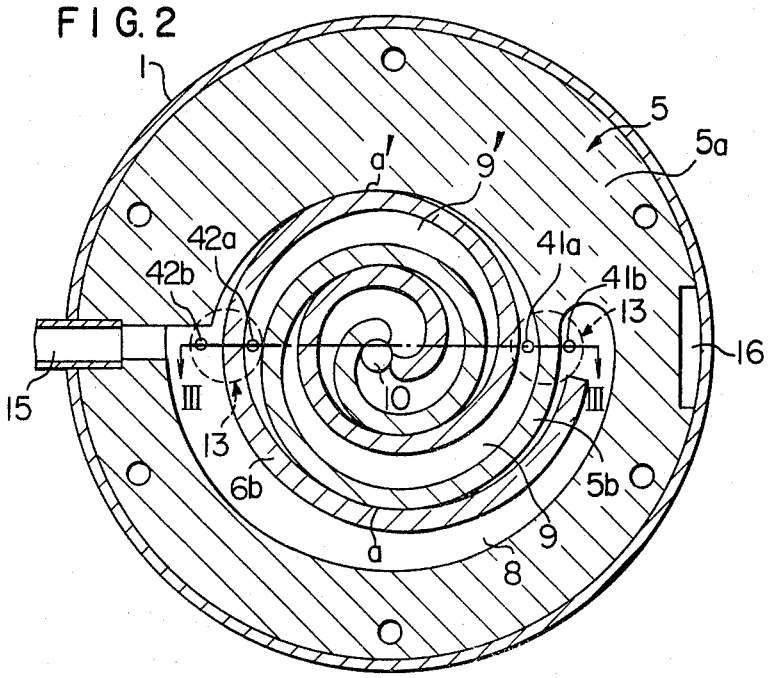
FIG. 2 is a transverse sectional view of a scroll member portion of the scroll type compressor.

FIGS. 1 and 2 show a refrigerating system incorporating therein the scroll type compressor according to one embodiment of the invention.

The scroll type compressor comprises a closed vessel 1, a compressor section 2 contained in the closed vessel 1 and an electric motor section 3 also contained therein. The compressor section 2 is composed of a stationary scroll member 5 and an orbiting scroll member 6 in meshing engagement with each other to define therebetween a suction chamber 8 and compression chambers 9. The fixed scroll member 5 includes an end plate 5*a* of the disc shape, and a wrap 5*b* in the form of an involute curve or a curve similar thereto located on the surface of the end plate 5*a* in an upstanding position. The stationary scroll member 5 is formed with a discharge port 10 in the central portion and a suction port 7 in an outer peripheral portion. The orbiting scroll member 6 includes an end plate 6*a* of the disc shape, a wrap 6*b* of the same shape as the wrap 5*b* of the stationary scroll member 5 located on the surface of the end plate 6*a* in an upstanding position, and a boss 6*c* formed on the undersurface of the end plate 6*a* opposite the surface on which the wrap 6*b* is located.

A frame 11 has mounted in the central portion thereof a bearing section 11*a* for journaling a crank shaft 4 having attached to its forward end an off-center crank pin 4*a* which is inserted for rotation in the boss 6*c*. The frame 11 has the stationary scroll member 5 bolted thereto in several positions, and the orbiting scroll member 6 is supported by the frame 11 through an Oldham's joint comprising an Oldham's ring and an Oldham's key, for orbiting movement with respect to the stationary scroll member 5 without rotating on its own axis.

The crank shaft 4 has secured to its lower portion an electric motor shaft 4*b* having the electric motor section 3 secured thereto.

Volume control mechanisms 13 are mounted on the end plate 5*a* of the stationary scroll member 5 which are subsequently to be described in detail. The volume control mechanisms 13 have a pressure introducing pipe 14 connected to their undersurfaces. A suction pipe 15 is connected to the suction port 7 of the stationary scroll member 5 after penetrating the wall of the closed vessel 1, and a discharge chamber 1*a* in which the discharge port 10 opens is maintained in communication with a lower chamber 1*b* via a passageway 16 and with a discharge pipe 17 penetrating the wall of the closed vessel 1.

In the scroll type compressor of the aforesaid construction, rotation of the crank shaft 4 directly connected to the electric motor section 3 causes the crank pin 4*a* to rotate eccentrically, and the eccentric rotation thereof is transmitted via the boss 6*c* to the orbiting scroll member 6, to move the latter in orbiting movement. As the orbiting scroll member 6 moves in orbiting movement, the compression chambers 9 gradually moves toward the center and their volume is reduced. Gas is drawn by suction through the suction pipe 15 to the suction chamber 8 via the suction port 7, and discharged through the discharge port 10 into the discharge chamber 1*a* after being compressed as aforesaid, to flow through the passageway 16 into the lower chamber 1*b* before being discharged through the discharge pipe 17.

A refrigeration circuit connected to the scroll type compressor of the aforesaid construction will now be described. The suction pipe 15 and discharge pipe 17 are connected at their ends to two flow lines of a four-way change-over valve 20 which has additional two flow lines one of which is connected to an outdoor heat exchanger 21 via a line 31 and the other of which is connected to an indoor heat exchanger 22 via a line 32. The two heat exchangers 21 and 22 are connected to each other through a line 33 mounting an expansion valve 23. Thus, the heat pump type refrigeration circuit is formed. By switching the four-way change-over valve 20 to a condition indicated by solid lines, a circuit connecting the discharge pipe 17 of the scroll type compressor, four-way change-over valve 20, outdoor heat exchanger 21, expansion valve 23, indoor heat exchanger 22, four-way change-over valve 20 and the suction pipe 15 of the scroll type compressor is formed as indicated by solid line arrows to allow a refrigerant to flow in the indicated order. In this circuit, the outdoor heat exchanger 21 functions as a condenser and the indoor heat exchanger 22 functions as an evaporator to perform a cooling operation. Also, by switching it to a condition indicated by broken lines, a circuit connecting the discharge pipe 17 of the scroll type compressor, four-way change-over valve 20, indoor heat exchanger 22, expansion valve 23, outdoor heat exchanger 21, four-way change-over valve 20 and the suction pipe 15 of the scroll type compressor is formed as indicated by broken line arrows to allow the refrigerant to flow in the indicated order. In this circuit, the indoor heat exchanger 22 functions as a condenser and the outdoor heat exchanger 21 functions as an evaporator to perform a heating operation.

The line 31 connecting the four-way change-over valve 20 to the outdoor heat exchanger 21 has a first branch line 34 connected thereto, and the line 32 connecting the four-way change-over valve 20 to the indoor heat exchanger 22 has a second branch line 35 connected thereto. The two branch lines 34 and 35 are connected at their ends to a first flow line and a second flow line of a three-way change-over valve 24 respectively, and a third flow line of the valve 24 is connected to the pressure introducing pipe 14. By actuating the three-way change-over valve 24, one of the two branch lines 34 and 35 can be selectively connected to the pressure introducing pipe 14.

Figure 3:
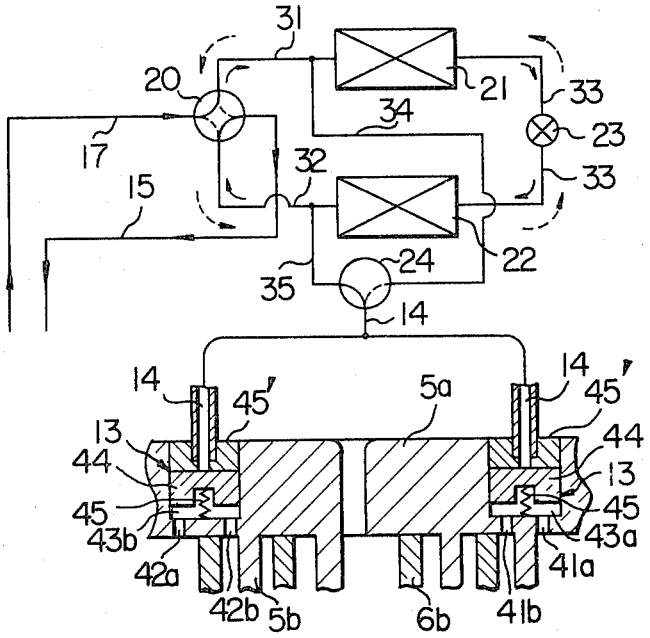
FIG. 3 shows in detail volume control mechanisms shown in a sectional view taken along the line III—III in FIG. 2, and a refrigerating circuit, in explanation of the operation of the volume control mechanisms.

The volume control mechanisms 13 will be described by referring to FIGS. 2 and 3. FIG. 2 is a sectional view of the compressor section 2 of the scroll type compressor shown in FIG. 1, and FIG. 3 shows the volume control mechanisms in a sectional view taken along the line III—III in FIG. 2 and a refrigeration circuit connected to the volume control mechanisms.

Bypass apertures 41*a* and 41*b* are formed on opposite sides of the wrap 5*b* on the end plate 5*a* of the stationary scroll member 5 and spaced apart from each other radially of the member 5, and radially spaced apart bypass apertures 42*a* and 42*b* are formed on opposite sides of the wrap 5*b* in positions on the end plate 5*a* which are in point symmetry with respect to the positions in which the bypass apertures 41*a* and 41*b* are formed. The two sets of bypass apertures 41*a* and 41*b* and 42*a* and 42*b* communicate with valve chambers 43*a* and 43*b* respectively on the undersurface, so that one set of bypass apertures and one valve chamber constitute a bypass passageway. The valve chambers 43*a* and 43*b* have valves 44 each mounted in one of the valve chambers for axial sliding movement and urged by a spring 45 of a suitable resilience to move upwardly. The valve chambers 43*a* and 43*b* are each closed by a plug 45 at the outside which is connected to the pressure introducing pipe 14 opening in the chambers 43*a* and 43*b*. Upward movement of the valves 44 brings the bypass apertures 41*a* and 41*b* and 42*a* and 42*b* into communications with each other through the valve chambers 43*a* and 43*b* respectively, to enable volume control or unloaded operation to be performed.

With the bypass apertures 41*a* and 41*b* and 42*a* and 42*b* being in communication with each other, the compression chambers 9 and 9' communicate with a first suction chamber 8 and no compression of the gas takes place, and compression is initiated after the two contact points and a' of the two wraps 5*b* and 6*b* have passed by the bypass apertures 41*a* and 42*a*. That is, the maximum sealed volume is reduced and an unloaded condition is brought about. Downward movement of the valves 44 closes the bypass apertures, to thereby enable full load operation to be performed.

Figure 4:
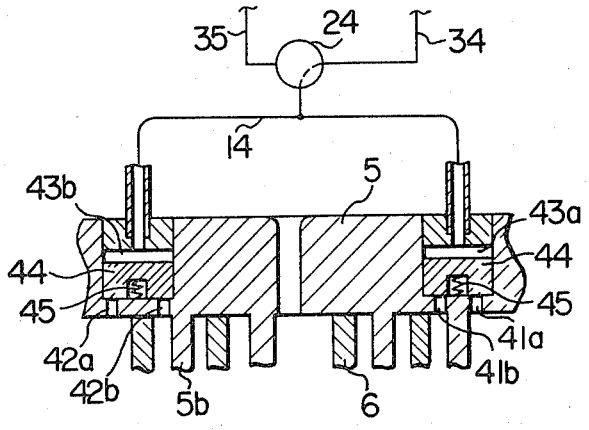
FIG. 4 shows the manner in which the volume control mechanisms shown in FIG. 3 operate differently from the manner of operation shown in FIG. 3.

In the illustrated refrigeration circuit, the first branch line 34 handles discharge pressure and the second branch line 35 handles suction pressure in a cooling operation in which the refrigerant flows in the direction indicated by the solid line arrows. When the four-way change-over valve 20 is switched to the condition indicated by the broken lines to cause the refrigerant to flow in the direction indicated by the broken line arrows to perform a heating operation, the second branch line 35 handles discharge pressure and the first branch line 34 handles suction pressure. In a cooling mode in which the four-way change-over valve 20 is switched to the condition indicated by the solid lines as shown, the discharge pressure handled by the first branch line 34 is cut off and the suction pressure handled by the second branch line 35 is transmitted to the pressure introducing pipe 14 to allow the suction pressure to act on the backs of the valves 44. Acting on the valves 44 are pressures in the suction chamber 8 and the compression chamber 9 passed through the bypass apertures 41*a*, 41*b* and 42*a*, 42*b* which are of the same value as the back pressure applied to the valves 44, so that the valves 44 are biased upwardly by the springs 45 to bring the system to an unloaded condition. If the three-way change-over valve 24 is switched to the condition indicated by the broken lines in a cooling mode, then the discharge pressure handled by the first branch line 34 acts on the backs of the valves 44 through the pressure introducing pipe 14 as shown in FIG. 4, so that the back pressure overcomes the pressures acting on the valves 44 through the bypass apertures 41*a*, 41*b* and 42*a*, 42*b* and the biasing forces of the springs 45. This biases the valves 44 downwardly, to bring the system to the full load condition. When the four-way change-over valve 20 is switched to the condition indicated by the broken lines in a heating mode, the system is brought to full load operation if the three-way change-over valve 24 is switched to the condition indicated by the solid lines (as opposed to the condition to which the valve is switched in a cooling mode) and it is brought to an unloaded operation if the three-way change-over valve 24 is brought to the condition as indicated by the broken lines (as opposed to the condition to which the valve is switched in a cooling mode).

It will be appreciated that by switching the three-way change-over valve 24 in accordance with the operation load both in cooling and heating modes, it is possible to switch the refrigerating system to a full load operation or unloaded operation.

If the four-way change-over valve 20 is switched to the condition indicated by the solid lines in a cooling mode or to the condition indicated by the broken lines in a heating mode while the three-way change-over valve 24 is kept in the condition indicated by the solid lines as shown in FIG. 3, then the refrigerating system is automatically switched to full load operation in a heating mode and to unloaded operation in a cooling mode. Thus, it is possible to perform unloaded operation by reducing the volume of the refrigerant in the refrigerating system in a cooling mode as compared with the operation in a heating mode, without requiring to perform an additional operation.

When the scroll type compressor is shut down, the high pressure and the low pressure in the refrigeration circuit become balanced and the back pressure led to the valves through the pressure introducing pipe 14 becomes same in value as the pressures acting in the bypass passageways. Thus, the system is brought to unloaded condition at the time of startup at all times. Stated differently, the system remains in unloaded condition until the discharge pressure rises following startup even if the three-way change-over valve 24 has been switched to full load operation condition. Thus, it is possible to reduce starting load and reduce electric input at startup.

FIGS. 5–10 show another embodiment. The embodiment described by referring to FIGS. 1–4 has a pair of (two) volume control mechanisms in a scroll type compressor for performing volume control in one stage. The embodiment shown in FIGS. 5–10 is provided with two pairs of (four) volume control mechanisms, to enable volume control to be carried out in a plurality of stages.

Figure 5:
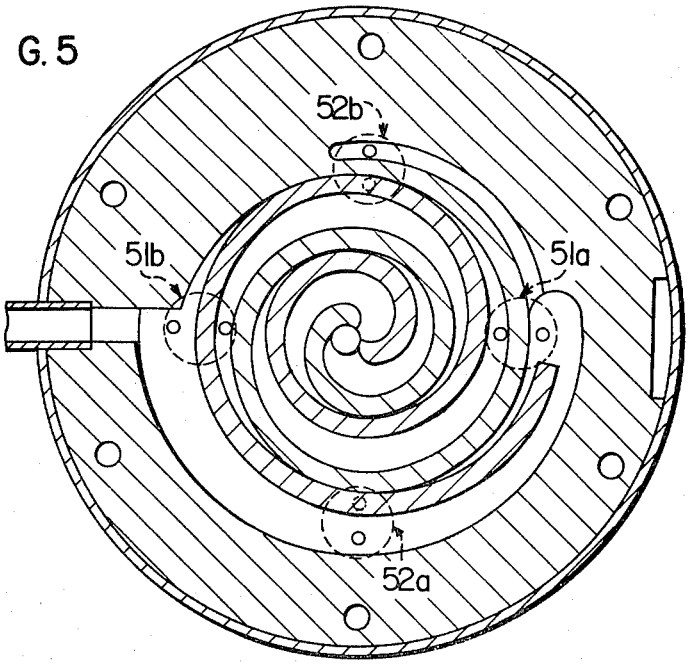
FIG. 5 is a transverse sectional view of the scroll member portion of the scroll compressor according to another embodiment.

FIG. 5 is a transverse sectional view of the compressor section in the same position as that shown in FIG. 2. In FIG. 5, the volume control mechanisms generally indicated by 51*a* and 51*b* are formed in the same positions and of the same construction as the volume control mechanisms 13 described by referring to FIGS. 2 and 3. Description of the details thereof will be omitted. In this embodiment, additional two volume control mechanisms 52*a* and 52*b* are provided. The volume control mechanisms generally indicated by 52*a* and 52*b* are of the same construction as those described hereinabove and located in positions intermediate between the volume control mechanisms 51*a* and 51*b*.

Figure 6:
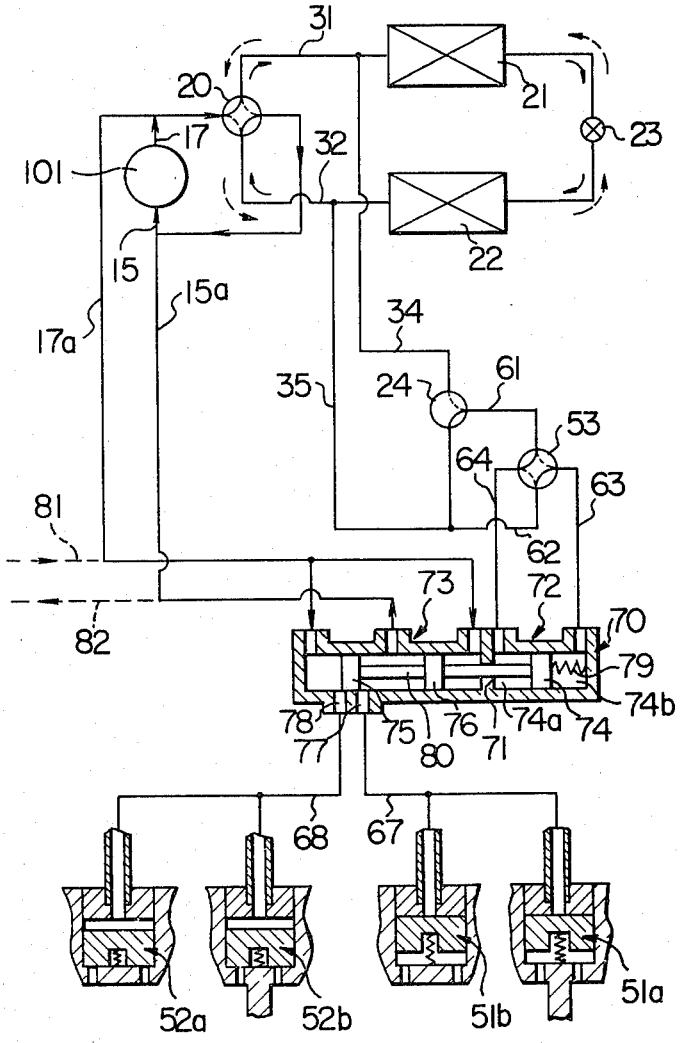
FIG. 6 is a view showing the volume control mechanisms and the refrigeration circuit shown in FIG. 5 and a connection system thereof.

In FIG. 6, the scroll type compressor which is generally indicated by 101, and it is to be understood that the volume control mechanisms 51*a*, 51*b*, 52*a* and 52*b* are built in the scroll type compressor 101. The discharge pipe 17 and the suction pipe 15 of the scroll type compressor 101 are connected to one flow line of the four-way change-over valve 20 which has the other flow line thereof connected to the outdoor heat exchanger 21, expansion valve 23 and indoor heat exchanger 22 in the indicated order to provide a refrigeration circuit. The first branch line 34 is connected to the line 31 and the second branch line 35 is connected to the line 32, and the two branch lines 34 and 35 are connected at the other ends to the three-way change-over valve 24. This construction is analogous to that in the first embodiment shown in FIG. 1. The embodiment shown in FIGS. 5–10 is distinct from the embodiment shown in FIG. 1 in the construction presently to be described.

The three-way change-over valve 24 has another switching flow line which is connected via a line 61 to a first flow line of a second four-way change-over valve 53, and the second branch line 35 is connected via a line 62 to a second flow line of the second four-way change-over valve 53. Lines 63 and 64 are connected to third and fourth flow lines respectively of the second four-way change-over valve 53, and the other ends of the lines 63 and 64 are connected to a pressure switching valve 70 which has a drive chamber 72 and a follower chamber 73 separated by a partition wall 71, the drive chamber 72 having apertures formed at opposite ends thereof to have the lines 63 and 64 connected therein. The follower chamber 73 has apertures formed at opposite ends and in the central portion, the apertures at the opposite ends having connected in parallel therein branch lines obtained by branching a high pressure line 17*a* connected to the discharge pipe 17 and the aperture in the central portion having connected therein a low pressure line 15*a* connected to the suction pipe 15.

The drive chamber 72 has a drive piston 74 arranged therein, and the follower chamber 73 has a follower piston 75 and a balance piston 76 arranged therein. These pistons are interlockingly connected, as shown, to a rod 80 penetrating the partition wall 71. The drive piston 74 has a spring 79 mounted therein. The balance piston 76 is intended to have the same pressure applied thereto to avoid rightward movement of the follower piston 75.

When the drive piston 74 is in its intermediate position, passageways 77 and 78 separated from each other by the follower piston 75 open on opposite sides of the follower piston 75. The passageways 77 and 78 have connected thereto pressure introducing pipes 67 and 68 respectively which each branch off at the forward end to have the four volume control mechanism connected thereto in two blocks each having two mechanisms. That is, the volume control mechanisms 51*a* and 51*b* are connected to one pressure introducing pipe 67, and the volume control mechanisms 52*a* and 52*b* are connected to the other pressure introducing pipe 68.

When the volume control mechanisms 51*a*, 51*b*, 52*a* and 52*b* are all closed, the system operates at full load, and when the pair of volume control mechanisms 51*a* and 51*b* open and the other pair of volume control mechanisms 52*a* and 52*b* are closed, the system operates at intermediate load. With all the volume control mechanisms 51*a*, 51*b*, 52*a* and 52*n* being open, the system operates at minimum load.

Operation of the embodiment shown in FIGS. 5–10 will be described. The four-way change-over valve 20 is switched to the condition indicated by solid lines, the three-way change-over valve 24 is switched to the condition indicated by solid lines and the second four-way change-over valve 53 is switched to the condition indicated by solid lines. That is, when the valves 20, 24 and 53 are in conditions as shown in FIG. 6, pressure acting on opposite ends of the drive piston 74 is low in value to place the drive piston 74 in the indicated position and the follower piston 75 in an intermediate position as shown. Thus, the gas of high pressure handled by the high pressure line 17*a* is led to the pressure introducing pipe 68 via a chamber disposed leftwardly of the piston 75 to cause high pressure to act on the backs of the valves of the volume control mechanisms 52*a*, and 52*b*, to close the bypass passageway. Meanwhile the gas of low pressure handled by the low pressure line 15*a* is led to the pressure introducing line 67 via a chamber rightwardly of the piston 75 to cause low pressure to act on the backs of the valves of the volume control mechanisms 51*a* and 51*b*, to open another bypass passageway. Thus, the refrigerating system operates at intermediate load.

When the three-way change-over valve 24 is switched (or has been switched) to the solid line position as shown in FIG. 6, the same pressure acts on the opposite ends of the drive piston 74 and the pistons are moved to intermediate positions, no matter what positions the two four-way change-over valves 20 and 53 have been moved to, or the four-way change-over valve 20 is switched to the solid line position in space cooling mode or to the broken line position in space heating mode or the four-way change-over valve 53 is switched either to the solid line position or to the broken line position. Thus, the volume control mechanisms 51*a* and 51*b* are open and the volume control mechanisms 52*a* and 52*b* are closed, to enable the system to operate at intermediate load.

When high pressure acts on a left chamber 74*a* of the drive piston 74 and low pressure acts on a right chamber 74*b* of the drive piston 74, the drive piston 74 moves rightwardly and the follower piston 75 linked thereto also moves rightwardly, to bring the pressure introducing lines 67 and 68 into communication with the high pressure line 17*a*. As a result, high pressure is applied to the backs of all the valves of the volume control mechanisms 51*a*, 51*b*, 52*a* and 52*b*, to close all the bypass passageways and allow the system to operate at full load.

Conversely, when low pressure acts on the left chamber 74*a* of the drive piston 74 and high pressure acts on the right chamber 74*a* thereof, the piston 74 is moved leftwardly, to bring the pressure introducing lines 67 and 68 into communication with the low pressure line 15*a*. As a result, low pressure acts on all the volume control mechanisms 51*a*, 51*b*, 52*a* and 52*b* to open all the bypass passageways and allow the system to operate at minimum load.

Thus, the refrigerating system can be made to operate at full load and minimum load in both space cooling and space heating modes by switching the second four-way change-over valve 53.

Figure 7:
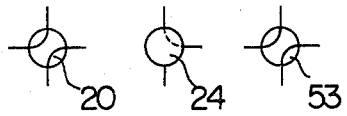
FIGS. 7–10 are views showing the operations of the four-way changeover valve, the three-way change-over valve and the second four-way changeover valve, respectively, in relation to one another.
Figure 8:
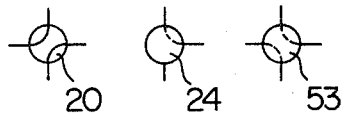

FIGS. 7–10 show various positions to which the change-over valves are switched. In FIGS. 7 and 8, the four-way change-over valve 20 is switched to the positions indicated by solid lines in a space cooling mode. In the event that the three-way change-over valve 24 is switched to the position indicated by broken lines, the system can be made to operate at full load by switching the second four-way change-over valve 53 to the position indicated by solid lines as shown in FIG. 7 and can be made to operate at a minimum load by switching the valve 53 to the position indicated by broken lines as shown in FIG. 8.

Figure 9:
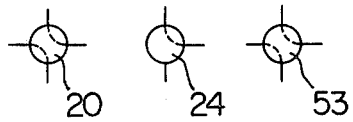
Figure 10:
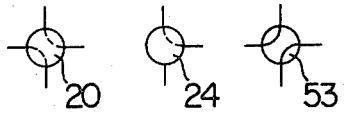

FIGS. 9 and 10 show the four-way change-over valve 20 switched to the position indicated by broken lines in a space heating mode. By switching the second four-way change-over valve 53 to the position indicated by broken lines as shown in FIG. 9, the system can be made to operate at full load by switching the valve 53 to the position indicated by solid lines as shown in FIG. 10, the system can be made to operate at minimum load.

In the embodiment shown in FIG. 6, the back pressure acting on the volume control mechanisms 51*a*, 51*b*, 52*a* and 52*b* is obtained from the discharge pressure and suction pressure of the scroll type compressor via the high pressure line 17*a* and the low pressure line 15*a*. However, oil pressure may be introduced through a high pressure oil line 81 and a low pressure oil line 82 indicated by broken lines, to use the oil pressure as back pressure to be applied to the volume control mechanisms to actuate the valves.

What is claimed is:

1. A refrigerating system comprising:

a scroll type compressor comprising a stationary scroll member formed with a discharge port, an orbiting scroll member in meshing engagement with said stationary scroll member in such a manner that the orbiting scroll member moves in orbiting movement with respect to said stationary scroll member without rotating on its own axis while a suction chamber and compression chambers are defined between said two scroll members, and at least one volume control mechanism comprising a bypass passageway communicating said suction chamber with said compression chambers, and a valve member mounted in said bypass passageway and movable between a normally open position and a closed position in which the valve member closes the bypass passageway, said valve member having axial one end exposed to pressurized fluid in said bypass passageway; and a refrigeration circuit comprising discharge line communicated with said discharge port, a suction line communicated with said suction chamber, first and second heat exchangers, a series line connecting said first and second heat exchangers in series with each other, an expansion valve mounted in said series line, a first branch line connected to said first heat exchanger, a second branch line connected to said second heat exchanger, first valve means movable between a first position where said discharge line is communicated with said first branch line and said second branch line is communicated with said suction line to allow a working fluid to flow from said compression chambers to said suction chamber through said first heat exchanger, said expansion valve, said second heat exchanger and said suction line and a second position where said discharge line is communicated with said second branch line and said first line is communicated with said suction line to allow the working fluid to flow from said compression chamber to said suction chamber through said second heat exchanger, said expansion valve, said first heat exchanger and said suction line, and second valve means movable between a first position where pressurized fluid in said first branch line is introduced to axial the other end of said valve member in said bypass passageway and a second position where pressurized fluid in said second branch line is introduced to said axial the other end of said valve member in said bypass passageway, whereby said valve member in said bypass passageway can be made to move between said open position and said closed position by the pressure differential between the pressures applied to said axial one end and said axial the other end of said valve member in said bypass passageway.

2. A refrigerating system as claimed in claim 1, wherein said bypass passageway includes bypass apertures formed in said stationary scroll member, and a valve chamber communicating with said bypass apertures, and wherein said at least one volume control mechanism includes a spring mounted in said bypass passageway and biasing said valve member to said open position.

3. A refrigerating system as claimed in claim 2, wherein said at least one volume control mechanism is two in number and the two volume control mechanisms are located symmetrically, and wherein said refrigerating circuit further comprises a pressure introducing pipe connected to said second valve means, and branch lines branching from said pressure introducing pipe connected to said two volume control mechanisms respectively to operatively link them to each other.

4. A refrigerating system as claimed in claim 3, wherein said second valve means comprises a three-way change-over valve being operative to selectively apply pressurized fluid from one of said branch lines to said axial one end of said valve members of said two volume control mechanisms.

5. A refrigerating system as claimed in claim 2, wherein said at least one volume control mechanism is four in number and the four volume control mechanisms are located symmetrically, said four volume control mechanisms being divided into two blocks each block including two volume control mechanisms operatively linked to each other and said two blocks being connected to said second valve means to enable volume control to be carried out in three stages.

6. A refrigerating system as claimed in claim 5, wherein said second valve means comprises a mechanism for selecting one of the fluid pressure in said first branch line and the fluid pressure in said second branch line, and a mechanism for selectively introducing either one of high pressure fluid and low pressure fluid to said axial the other end of each of said valve members of said volume control mechanisms by using the selected fluid pressure.

7. A refrigerating system as claimed in claim 5, wherein said second valve means comprises a three-way change-over valve, a second four-way change-over valve and a pressure change-over valve.

8. A refrigerating system as claimed in claim 7, wherein said three-way change-over valve is operative to select one of pressurized fluid in said first branch line and pressurized fluid in said second branch line and introducing the selected pressurized fluid into said four-way change-over valve, said four-way change-over valve introducing said selected one pressurized fluid and the other pressurized fluid into said pressure change-over valve, to thereby selectively apply high pressure fluid and low pressure fluid to said axial the other end of each of said valve members of each of said volume control mechanisms.

9. A refrigerating system as claimed in claim 8, wherein said pressure change-over valve comprises a drive chamber, a follower chamber, a drive piston slidably mounted in said drive chamber, a follower piston slidably mounted in said follower chamber and a balance piston, said pistons being all operatively linked to one another, said drive piston being actuated in accordance with pressures reversibly introduced into opposite ends of the drive piston, the high pressure fluid and the low pressure fluid being led to said follower chamber and selectively applied by said follower piston to said axial the other end of each of said valve members of each of said volume control mechanisms.

10. A refrigerating system as claimed in claim 9, wherein the high pressure fluid and the low pressure fluid introduced into said follower chamber are discharged fluid and suction fluid of said scroll fluid compressor, respectively.

11. A refrigerating system as claimed in claim 8, wherein the high pressure fluid and the low pressure fluid introduced into said follower chamber are high pressure oil and low pressure oil respectively.

12. A refrigerating system comprising:

a scroll type compressor comprising a stationary scroll member including an end plate, and a wrap of the vertical form located on the surface of said end plate in an upstanding position, an orbiting scroll member including an end plate, and a wrap of the vertical form located on the surface of the end plate in an upstanding position for meshing engagement with said wrap of said stationary scroll member to define suction chamber and compression chamgers between said two scroll members, said orbiting scroll member moving in orbiting movement with respect to said stationary scroll member without rotating on its own axis, a discharge port formed in the center of said end plate of said stationary scroll member, a suction pipe communicating with said suction chamber, a discharge pipe communicating with said discharge port, and two volume control mechanisms, each of said two volume control mechanisms comprising a bypass passageway including a pair of bypass apertures located in spaced apart relation and each communicating said suction chamber with said compression chambers and a valve chamber communicating with said bypass apertures, a valve member mounted in said bypass apertures, and a spring biasing said valve member in a direction in which the valve member is brought to an open position; and a refrigeration circuit comprising a four-way change-over valve connected to said suction pipe and said discharge pipe, an outdoor heat exchanger, an expansion valve and an indoor heat exchanger, said refrigerating circuit further comprising a first branch line connected to a line connecting said four-way change-over valve to said outdoor heat exchanger, a second branch line connected to a line connecting said four-way change-over valve to said indoor heat exchanger, a three-way change-over valve connected to said first branch line and said second branch line and having a switching fluid line, a pressure introducing pipe connected to said switching fluid line at one end and to the back of said valve member at the other end, said three-way change-over valve being switched to selectively introduce pressurized fluid from one of said first branch line and said second branch line to the back of said valve member, to thereby effect compression volume control by actuating said valve member by the differential pressure between the pressure in said suction chamber acting on said valve member and the back pressure applied to said valve member.

13. A refrigerating system comprising:

a scroll type compressor comprising a stationary scroll member including an end plate and a wrap of the vertical form located on the surface of said end plate in an upstanding position, an orbiting scroll member including an end plate, and a wrap of the vertical form located on the surface of said end plate in an upstanding position for meshing engagement with said wrap of said stationary scroll member to define a suction chamber and compression chambers between said two scroll members, said orbiting scroll member moving in orbiting movement with respect to said stationary orbiting member without rotating on its own axis, a discharge port formed in the center of said end plate of said stationary scroll member, a suction pipe communicating with said suction chamber, a discharge pipe communicating with said discharge port, and four volume control mechanisms arranged symmetrically and divided into two blocks each block including two volume control mechanisms operatively linked to each other, each of said four volume control mechanisms comprising a bypass passageway including a pair of bypass apertures located in spaced apart relation and each communicating said suction chamber with said compression chambers and a valve chamber communicating with said bypass apertures, a valve member mounted in said bypass apertures, and a spring biasing said valve member in a direction in which the valve member is brought to an open position; and a refrigeration circuit comprising a four-way change-over valve connected to said suction pipe and said discharge pipe, an outdoor heat exchanger, an expansion valve and an indoor heat exchanger, said refrigeration circuit further comprising a first branch line connected to a line connecting said four-way change-over valve to said outdoor heat exchanger, a second branch line connected to a line connecting said four-way change-over valve to said indoor heat exchanger, a three-way change-over valve connected to said first branch line end said second branch line and having a switching fluid line, a second four-way change-over valve connected to said switching fluid line and said second branch line and formed with a pair of switching fluid lines, a pressure change-over valve including a drive chamber, a follower chamber, a drive piston mounted in said drive chamber and dividing the latter into two sections, a follower piston mounted in said follower chamber and a balance piston, said second four-way change-over valve having said pair of switching fluid lines reversibly connected to said two sections of said drive chamber, and discharge fluid and suction fluid of said scroll type compressor being introduced into said follower chamber and selectively introduced to the back of said each valve member, whereby compression volume control can be effected by actuating said valve member by the differential pressure between the pressure in said suction chamber acting on said valve member and the back pressure applied to said valve member.

* * * * *